US009539641B2

(12) United States Patent
Ellingsworth et al.

(10) Patent No.: US 9,539,641 B2
(45) Date of Patent: Jan. 10, 2017

(54) METHOD OF CLOSING A BORE

(71) Applicant: Miba Sinter Austria GmbH, Laakirchen (AT)

(72) Inventors: Rick Ellingsworth, McConnelsville, OH (US); Paul Tacke, Pleasant Ridge, MI (US); Gerold Stetina, Voecklabruck (AT)

(73) Assignee: Miba Sinter Austria GmbH, Laakirchen (AT)

( * ) Notice: Subject to any disclaimer, the term of this patent is extended or adjusted under 35 U.S.C. 154(b) by 85 days.

(21) Appl. No.: 14/271,658

(22) Filed: May 7, 2014

(65) Prior Publication Data

US 2014/0352128 A1 Dec. 4, 2014

(30) Foreign Application Priority Data

May 28, 2013 (AT) ..... A 50359/2013

(51) Int. Cl.
*B22F 7/06* (2006.01)
*B22F 5/10* (2006.01)
(Continued)

(52) U.S. Cl.
CPC ..... *B22F 7/062* (2013.01); *B22F 5/10* (2013.01); *B22F 3/12* (2013.01); *B22F 7/08* (2013.01); *B22F 2301/10* (2013.01); *B22F 2998/10* (2013.01); *B22F 2999/00* (2013.01); *Y10T 29/49826* (2015.01); *Y10T 29/49925* (2015.01)

(58) Field of Classification Search
CPC ..... B22F 5/10; B22F 2005/103; B22F 5/106; B22F 7/008; B22F 7/06; B22F 7/062;B22F 7/08; B22F 2998/10; B22F 2999/00; B22F 3/12; B22F 2003/023; B23P 11/00; B23P 11/02; Y10T 29/49865; Y10T 29/49925; Y10T 29/49938; B65D 39/06; F16L 55/1133; F16N 21/06; F16N 99/00
See application file for complete search history.

(56) References Cited

U.S. PATENT DOCUMENTS 3,825,146 A * 7/1974 Hirmann ..... B65D 39/12 138/89
3,952,395 A * 4/1976 Crossman ..... F16L 55/13 138/89

(Continued)

FOREIGN PATENT DOCUMENTS

EP 2172667 A1 4/2010
EP 2301694 A2 3/2011
JP 11293306 A * 10/1999 ..... B22F 7/06

OTHER PUBLICATIONS

Machine translation of JP 11293306 A, generated on Sep. 24, 2015.*

*Primary Examiner* — Christopher Besler
*Assistant Examiner* — Matthew P Travers
(74) *Attorney, Agent, or Firm* — Collard & Roe, P.C.

(57) ABSTRACT

The invention relates to a method of closing a bore (3) in a metal sintered component (2), whereby, prior to sintering a preform (1) to obtain the sintered component (2) or before a step of calibrating the sintered component (2), a closing body (5) is pushed into the bore (3), and the closing body (3) has an external diameter that is either of an identical size to or at least partially larger than the internal diameter (9) of the bore (3).

7 Claims, 2 Drawing Sheets

(51) Int. Cl.
*B22F 3/12* (2006.01)
*B22F 7/08* (2006.01)

(56) References Cited

U.S. PATENT DOCUMENTS

| | | | | | |
|---|---|---|---|---|---|
| 4,236,923 | A * | 12/1980 | Takahashi | B22F 7/062 | 419/47 |
| 4,988,375 | A * | 1/1991 | Bornhauser | G02B 6/32 | 385/35 |
| 5,233,738 | A * | 8/1993 | Finkbeiner | B24B 39/02 | 29/90.01 |
| 5,443,097 | A * | 8/1995 | Pfeiffer | F16L 55/10 | 138/89 |
| 6,017,489 | A * | 1/2000 | Woolf | B22F 3/16 | 419/26 |
| 6,101,713 | A | 8/2000 | May et al. | | |
| 6,120,727 | A * | 9/2000 | Asaka | B22F 7/062 | 419/6 |
| 6,365,093 | B1 * | 4/2002 | Ryang | B22F 1/0059 | 419/36 |
| 8,171,961 | B2 * | 5/2012 | Koyama | F16L 55/11 | 138/89 |
| 2002/0135107 | A1 * | 9/2002 | Nishi | B01D 46/0001 | 264/630 |
| 2009/0126908 | A1 | 5/2009 | Lin | | |
| 2011/0182684 | A1 | 7/2011 | Yoon et al. | | |
| 2014/0238321 | A1 * | 8/2014 | Lettmann | B23P 11/025 | 123/90.1 |

* cited by examiner

METHOD OF CLOSING A BORE

CROSS REFERENCE TO RELATED APPLICATIONS

Applicant claims priority under 35 U.S.C. §119 of Austrian Application No. A 50359/2013 filed on May 28, 2013, the disclosure of which is incorporated by reference.

The invention relates to a method of closing a bore in a metal sintered component as well as a metal sintered component with a bore.

A method of closing bores, such as blind bores, in metal components made from solid material known from the prior art is to press in spheres. In order to improve the seating of the sphere in the bore, it is caulked after being pressed in.

The underlying objective of this invention is to close a bore in a metal sintered component.

This objective is achieved on the one hand by the method and on the other hand by the sintered component, and the method is such that, prior to sintering the sintered component or prior to a step of calibrating the sintered component, a closing body is pressed into the bore, and the closing body has an external diameter that is either of an identical size to or at least partially larger than the diameter of the bore, or the bore in the sintered component is closed by means of a metal closing body which is pressed into the bore.

The advantage of this is that the press-fit seating of the closing body in the bore of the sintered component is improved. This is achieved on the one hand due to the fact that the closing body is pushed in prior to sintering, in other words into the so-called preform. This enables the closing body to be more effectively secured in its position, especially if a higher pressure is exerted on the closing body by the wall of the bore due to expansion of the sinter material during the sintering process. If the closing body is pressed into the bore after sintering but before calibrating the sintered component, a higher pressing force is likewise exerted on the closing body by the subsequent calibration because during the calibration process to adapt the dimensions of the sintered component to the desired dimensions, pressure is likewise exerted on the sintered component which continues into the bore so that it effectively causes a second "pressing-in step" of the closing body. Closing bodies which have a diameter of an identical size to the diameter of the bore are preferably used in situations where the closing body is inserted in the preform, in other words after pressing the sinter powder but prior to sintering.

Another advantage of pressing the closing body into the preform is that this is an easier option due to the lower preform strength but at the same time, the wall of the bore can be surface compacted. The latter can also be achieved as a side-effect of inserting the closing body in the bore after sintering. As a result, the imperviousness of the bore to fluid can be improved at the same time, due to lower porosity.

With both variants of the method, the closing body can be subjected to a higher pressure of the fluid present in the bore during operation of the sintered component. For example, this is of importance for lubricant passages through the sintered component which are partially closed.

Based on one embodiment of the method, the sintered component with the closing body having been inserted prior to sintering may also be calibrated after the sintering process, in which case the effects outlined above can also be achieved or enhanced with this embodiment, thereby enabling the pressure tightness of the closure to be further improved.

Another option is to ream the bore before inserting the closing body. Reaming makes the diameter of the bore larger so that the bore has at least one step along its course where its diameter is smaller. Based on this embodiment, the process of inserting the closing body by machine can be improved because there is a better guarantee that the closing body can be prevented from being pressed too far into the bore.

It is preferable if a sphere is used as the closing body. The advantage of this is that the contact surface during the pressing-in process is relatively small, being limited in particular to only a portion of the sphere surface, as a result of which the force or pressure exerted on the wall of the bore during pressing in can be increased, thereby improving displacement of the material as the sphere is being pressed in. This in turn leads to a higher compaction of the wall of the bore in the region of the pressing path, improving the retaining force and seal of the closure. This means that a higher fluid pressure can be applied to the closing body from the bore side.

Based on another embodiment, a first sinter powder may be used to produce the sintered component, in which an additive is incorporated with a view to increasing the strength of a preform pressed from the first sinter powder. In particular, the additive used is a powdered thermosetting plastic. This additive improves the cohesiveness of the powder grains in the preform. Another consequence of this is that it also improves the process of inserting the sphere by machine and reduces the amount of reject material caused by breakage of preforms during the insertion operation. The advantage of using a thermosetting plastic powder is that it assumes an at least partially soft plastic state at temperatures slightly above room temperature and early on compared with the sintering temperature and improves the "adhesion" of the metal powder grains. Furthermore, the thermosetting plastic powder can be removed from the preform again relatively easily at sintering temperature.

Another option is to use a second preform as the closing body made from another sinter powder, the composition of which is different from the sinter powder of the sintered component incorporating the bore, and this other sinter powder undergoes has a higher change in dimension than the first sinter powder during sintering, in particular contains a higher proportion of copper. As a result, the closing body grows to a more pronounced degree in terms of its dimensions, in other words expands to a more pronounced degree, than the sintered component incorporating the bore, due in particular to the higher copper content, thereby enabling the retaining force of the closing body in the bore to be increased because a higher pressing force can be generated by the closing body on the wall of the bore.

However, another option is to use a closing body made from a metal solid material. This in turn has an advantage in that the closing body itself is not surface compacted as it is pressed into the bore, so that the entire force for compacting the surface and displacing the material is applied to the region of the wall of the bore. As a result, this also enables the retaining force of the closing body in the bore and the seal of the closure to be improved.

In order to make the deformability and displacement of the material of the sintered components in the region of the bore easier, another option is for the closing body to be pressed into the still hot preform after sintering. This offers a better way of preventing micro-tears from occurring in the sintered component in the region of the bore as the closing body is being pressed in.

To provide a clearer understanding, the invention will be described in more detail with reference to the appended drawings.

These are schematically simplified diagrams illustrating the following:

Figure 1:
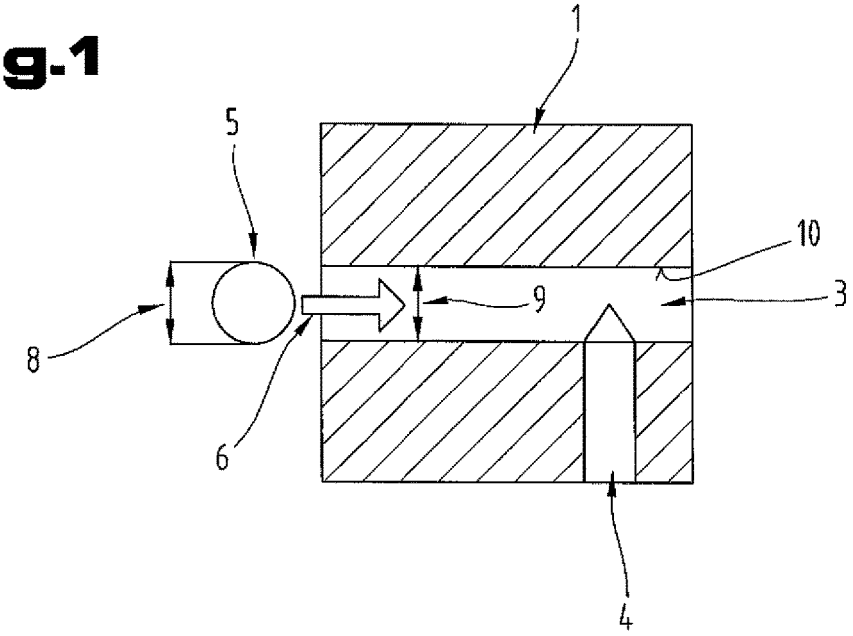
FIG. 1 is a side view in section illustrating a detail from a sintered component before inserting a closing body in a bore.
Figure 2:
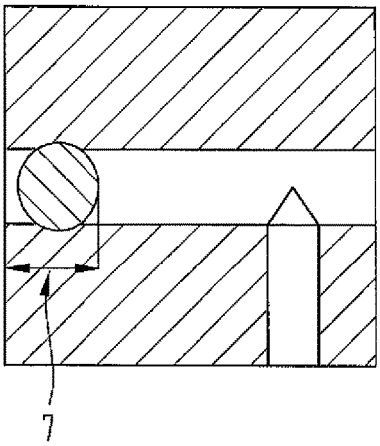
FIG. 2 is a side view in section showing the detail of the sintered component illustrated in FIG. 1 after inserting the closing body in the bore.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIGS. 1 to 4 illustrate different method stages of a method of closing a bore in a metal sintered component in a side view in section and a plan view.

Sintering methods for producing components from metal powders have long been known from the prior art. A standard sintering process comprises the steps of filling a pressing mold with a sinterable material, pressing it to obtain a so-called preform, sintering this preform at sintering temperature, optionally followed by homogenization, and subsequent calibration and optionally hardening. For more details, reference may be made to the relevant prior art.

Figure 3:
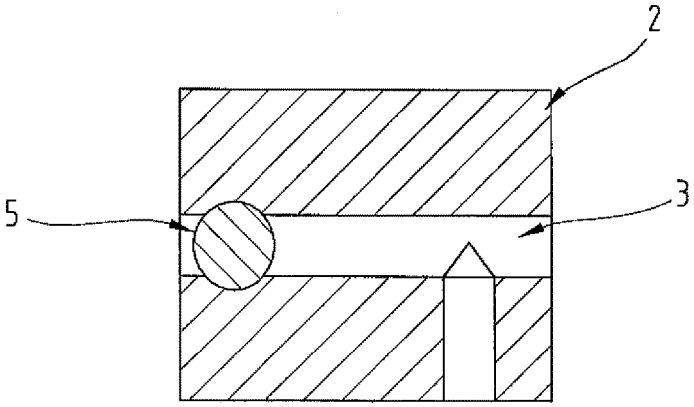
FIG. 3 is a side view in section showing the detail of the sintered component illustrated in FIG. 1 with the closing body inserted in the bore after sintering and calibration.

FIG. 1 is a detail of a preform 1 for producing a sintered component 2, part of which is illustrated in FIG. 3. A first bore 3 and a second bore 4 have been made in the preform 1. The second bore 4 extends at least approximately at a right angle to the first bore 3.

In order to channel a fluid, in particular to channel a lubricant, such as lubricating oil for example, into mechanical components, it is necessary to form appropriate passages in these components. In doing this, it may be necessary to deflect the fluid inside the component. From a manufacturing point of view, it is not generally technically possible to create a passage with a change in direction. This being the case, two bores are made extending at a specific angle to one another, as illustrated by way of example in FIG. 1. In respect of FIG. 1, it should be pointed out that the layout of the two bores 3, 4 extending at a right angle to one another should be seen as just an example. Naturally, the two bores 3, 4 may also subtend angles other than 90°. The exact angle will depend on the properties of the component and on requirements as to how the fluid is to be channeled.

The two bores 3, 4 are naturally each formed from a surface of the component, i.e. in the example illustrated in FIG. 1 are each introduced from a surface on the preform 1 into the component or preform 1. In connection with this, a part-portion of one bore, e.g. the first bore 3 illustrated in FIG. 1, which extends from the opening of the other, e.g. the second bore 4 illustrated in FIG. 1, as far as the respective surface, is not needed for channeling fluid as such. Rather, it is undesirable for fluid to be able to get out of the component through this first bore. It is therefore necessary to close this first bore, i.e. the first bore 1 illustrated in FIG. 1.

To this end, based on a first embodiment of the method of closing a bore in a metal sintered component, a closing body 5 is introduced into the first bore 3 of the preform 1, in other words prior to sintering. Accordingly, the closing body 5 is pressed into the first bore 3 as indicated by arrow 6. The pressing in operation may be performed by machine and on a fully automated basis. Appropriate presses may be used for this purpose, which retain the preform 1 in a co-operating holder whilst the pressing in operation is performed by a punch.

The closing body 5 is preferably a sphere or a body with an at least approximately spherical shape. However, it would also be possible to use closing bodies 5 with other shapes, for example wedge shapes or ellipsoid shapes, etc. In the situation where, instead of the first bore 3, a recess or orifice with a geometry other than a circular geometry is introduced into or formed in the preform 2, for example of a square shape, etc., the closing body 5 may also be based on a geometry other than that described and will have a cross-section which is adapted to this recess or orifice.

The closing body 5 is pressed into the first bore 3 to a depth 7. This depth 7 may be selected from a range of 100% to 150% of a diameter 8 of the closing body 5 if the latter is a sphere. In the situation where the closing body 5 has a shape based on anything other than a spherical geometry, the closing body 5 is preferably pressed in to a depth 7 of between 100% and 150% of the height of the closing body 5 in the direction of the first bore 3, in other words in the direction of arrow 6. The closing body 5 is therefore preferably pressed at least far enough into the first bore 3 so that it does not protrude beyond the surface of the finished sintered component 2 in which the closed bore is formed. On the other hand, it is also not pushed so far into the first bore 3 that the closing body 5 also at least partially closes the second bore 4.

The diameter 8 of the closing body 5 or the corresponding dimension in the case of non-spherical closing bodies 5 is dimensioned so that it is bigger than an internal diameter 9 of the first bore 3.

For the sake of completeness, it should be pointed out that the diameter 8 and internal diameter 9 relate to the same direction, in other words at a right angle with respect to the extension of the first bore 3 in the direction of arrow 6.

The diameter 8 of the closing body 5 preferably has a value which corresponds to between 102% and 130%, in particular between 105% and 120%, of the internal diameter 9 of the first bore 3. This results in a corresponding surface compaction of an internal wall 10 of the first bore. The surface or surface region, i.e. the layers of the preform 1 or sintered component 2 lying below the surface, is preferably compacted to a density corresponding to between 95% and 100% of the solid density of the material used.

By solid density is meant the density which a solid material of the same composition has.

A solid material is a material of the same composition which was not produced by a sintering process but by a metallurgical process involving melting.

Once the closing body 5 has been inserted in the preform 1, the latter is sintered in the usual manner.

The sintered pressing is preferably then subjected to a calibration process. During this, the actual dimension is approximated or adapted to the desired dimension by appropriate presses or other calibrating devices known from the prior art. The sintered component 2 obtained as a result, illustrated by way of example in FIG. 3, has different dimensions from the sintered pressing as a rule. For this reason, the sintered component 2 illustrated in FIG. 3 is shown as being smaller to provide clarification.

The pressure acting on the closing body 5 during calibration causes the closing body to be pressed even more effectively into the first bore 3, thereby enabling the force holding the closing body 5 to be increased.

Figure 4:
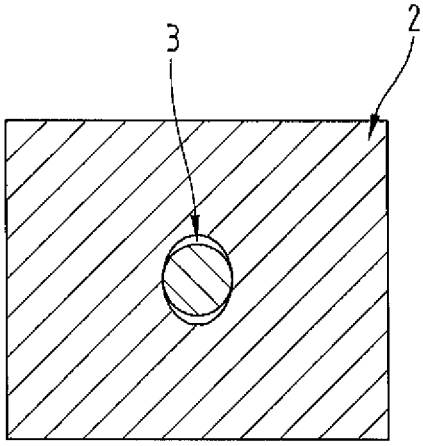
FIG. 4 is a plan view of the detail of the sintered component illustrated in FIG. 3 showing the closed bore.

FIG. 4 shows a plan view of the first bore 3 in the sintered component 2. As may be seen from this drawing, the first bore 3 assumes an oval shape due to calibration so that the first bore 3 no longer has a round cross-section. Firstly, it is clearly evident that the closing body had already been inserted before calibration. Secondly, the fact that an oval shape has been assumed increases the force holding the closing body 5 in the first bore by means of the press-fit seating.

However, the press-fit seating of the closing body 5 can still be achieved without calibration in the case of one embodiment of the method whereby—as described—the closing body 5 is pressed into the preform 1 prior to sintering already.

Based on another embodiment of a method of closing a bore in a metal sintered component, the closing body 5 may be inserted or pressed in after sintering the preform 1 but before calibration, which in this case must then necessarily be performed after sintering. For a clearer understanding of this approach, reference may be made to the diagrams of FIGS. 1 to 4 but in this case, FIG. 1 illustrates the situation after sintering the preform already, in other words the sintered pressing. To avoid unnecessary repetition, therefore, reference may be made to the explanations given above.

Figure 5:
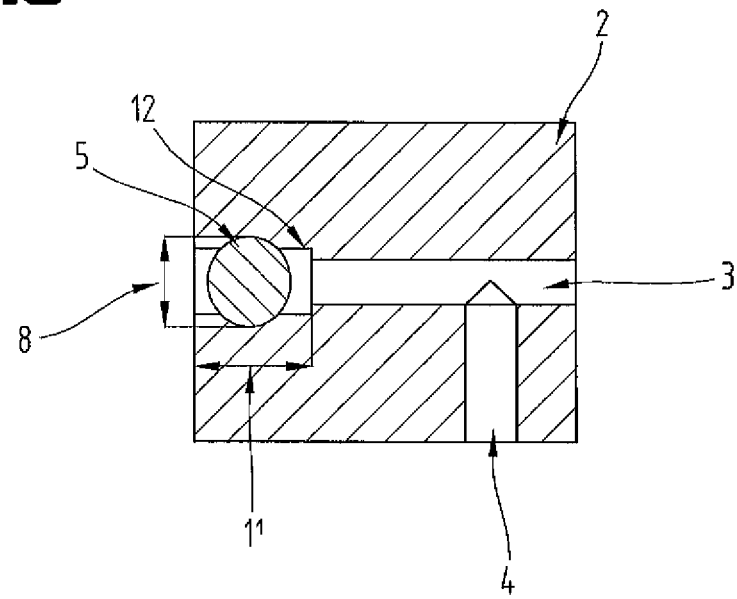
FIG. 5 is a side view in section showing a detail of an embodiment of a sintered component with a closing body inserted in a bore after sintering and calibration.

FIG. 5 illustrates a detail of another embodiment of the sintered component 2, which may be construed as an independent embodiment in its own right, the same reference numbers and component names being used for parts that are identical to those described in connection with FIGS. 1 to 4 above. To avoid unnecessary repetition, reference may be made to the detailed description of FIGS. 1 to 4 given above.

The main difference with this embodiment of the sintered component 1 compared with the embodiments described above and hence also the described methods is that the first bore 3 is reamed before inserting the closing body 5, in other words an additional method step is carried out.

By the term "reaming" is meant that certain regions of the cross-section of the first bore 3 are made larger. The machined region extends from the surface of the sintered component 1, where the first bore 3 starts, as far as a reaming depth 11. The reaming depth 11 is preferably selected from a range of 100% to 200% of the diameter 8 of the closing body 5 or corresponding dimension of the closing body 5, as explained above in connection with the depth 7 (FIG. 2).

Along its course in the direction towards the second bore 4, the first bore 3 therefore has at least one step 12. With the aid of this step 12, the closing body 5 can be prevented from being pushed or pressed too deep into the first bore 3 in the direction towards the second bore 4.

The first bore 3 may be reamed by means of a stepped drill, for example, or a stepped bore can be produced using a stepped drill, generally speaking, so that the step 12 can also be easily produced in the preform 1 if necessary.

In the context of the invention, the closing body 5 used is preferably made from a metal solid material, for example steel, brass, etc.

However, it would also be possible for the closing body 5 to be made from a sintered material. In this case, a first metal sinter powder is used to produce the sintered component 2. To produce the closing body 5, a second metal sinter powder is used, the composition of which is different from the first sinter powder, and the composition of the second sinter powder is selected so that the preform for the closing body 5 produced from it undergoes a greater change in its dimensions. During sintering, this preform expands to a more pronounced degree than the preform made from the first sinter powder. In particular, the second sinter powder contains a higher proportion of copper.

The expression "higher proportion of copper" also includes a situation where the first sinter powder contains no copper.

A preform is also pressed from the second sinter powder, from which the closing body 5 is produced. The preform, in other words the as yet non-sintered sinter powder pressed into shape for the closing body 5, is preferably inserted into the first bore 3 of the preform 1 in the preform state (both shown in FIG. 1) prior to sintering the preform 1.

During the sintering process, the closing body 5 grows in size more than the preform 1 of the sintered component 2 due in particular to the higher copper content, as a result of which a press-fit seating between the closing body 5 and internal wall 10 (FIG. 1) of the first bore 1 (FIG. 1) is formed and improved after sintering.

The second sinter powder for producing the closing body 5 may be a sintering material in particular, which has a copper content that is higher by at least 0.1% by weight and therefore swells more than the first sinter powder, thereby creating an additional bond.

In all the embodiments of the sintered component 2 and the method of closing a bore, a strength-enhancing additive may be added to the (first) sinter powder for producing the preform 1 and/or second sinter powder for producing the closing body 5, which increases the preform strength.

This additive is preferably a thermosetting plastic, i.e. a thermosetting polymer. In particular, this additive is selected from a group comprising aminoplasts, e.g. (although not only) melamine resin, urea resin, urea formaldehyde resin, or phenoplasts, e.g. (although not only) phenol resin, bakelite, and mixtures thereof.

The additive is added to the metal sinter powder(s) in powdered form in order to obtain thorough mixing.

The proportion of additive relative to the total sinter powder may be selected from a range of 0.03% by weight to 2% by weight.

Based on another embodiment of the method of closing a bore in a sintered component, the closing body may be pressed into the still hot sintered component 2 (FIG. 3) after sintering the preform 1 (FIG. 1), in particular immediately after sintering, and before calibration. In this respect, the sintered component 2 may have already cooled to a certain extent, but cooling will not yet have reached the point where the sintered component 2 is already at room temperature. In particular, the temperature of the sintered component 2 is between 100° C. and 200° C. when the closing body 5 is pushed in.

In principle, it is also possible for the closing body 5 to be pressed into the already finished and calibrated sintered component 2. However, if opting for this approach, the advantages associated with the embodiments of the methods described above and the sintered components 2 produced by these methods will not be achieved to the same degree or will not be achieved at all. The force holding the closing body 5 in the first bore 3 and the tight seal of the closure can be specifically influenced by the displaced material and the pressing-in force. With the proposed methods, more material can be displaced with less pressing-in force, as a result of which the press-fit seating of the closing body 5 can be improved.

Due to the improved retaining force, the first bore 3 may be made very close to a side edge of the sintered component 2.

By "very close" is meant at a distance of between 0.5 mm and 5 mm from the respective edge. This enables the effective length of the fluid passages in the sintered component 2 to be made larger.

Another advantage offered by the invention is that all the machining work needed to produce fluid passages in the sintered component 2 can be performed as early as the preform stage, making machining easier and less harsh on tools.

The examples of embodiments represent possible embodiments of the method of closing a bore in a metal sintered component 2 and it should be pointed out at this stage that combinations of the individual embodiments with one another are also possible.

For the sake of good order, finally, it should also be pointed out that, in order to provide a clearer understanding of the structure of the sintered component 2, it and its constituent parts are illustrated to a certain extent out of scale and/or on a larger scale and/or on a smaller scale.

LIST OF REFERENCE NUMBERS

1 Preform
2 Sintered component
3 Bore
4 Bore
5 Closing body
6 Arrow
7 Depth
8 Diameter
9 Internal diameter
10 Internal wall
11 Reaming depth
12 Step

The invention claimed is:

1. A method of closing a bore in a metal sintered component, comprising the following steps:

forming a green compact with a bore, sintering the green compact to form a sintered component with a bore, and press-fitting a closing body into the bore after sintering the green compact and subsequently calibrating the sintered component using a calibrating device to further press the bore around the closing body, wherein the closing body has an external diameter equal to or larger than the internal diameter of the bore wherein:

(1) the closing body is made from a metal solid material or (2) the sintered component is made from a first sintered metal powder and the closing body is made from a second sintered metal powder, and wherein the bore is part of a fluid channel within the sintered component having a change in direction.

2. The method according to claim 1, wherein the method comprises the following additional step:

reaming the bore before inserting the closing body.

3. The method according to claim 1, wherein the closing body comprises a sphere.

4. The method according to claim 1, wherein the green compact comprises a first sinter powder and wherein the method further comprises a step of:

adding an additive for increasing the strength of the green compact pressed from the first sinter powder to produce the sintered component.

5. The method according to claim 4, wherein the additive comprises a thermosetting plastic in powdered form.

6. The method according to claim 1, wherein the closing body is made from a metal solid material.

7. The method according to claim 1, wherein the closing body is pressed into the bore while the sintered component is still hot after the sintering of the green compact.

* * * * *